United States Patent [19]

Borton et al.

[11] Patent Number: 4,993,233

[45] Date of Patent: Feb. 19, 1991

[54] DEMAND DEFROST CONTROLLER FOR REFRIGERATED DISPLAY CASES

[75] Inventors: David N. Borton, Troy, N.Y.; David H. Walker, Winchester, Mass.

[73] Assignee: Power Kinetics, Inc., Troy, N.Y.

[21] Appl. No.: 385,103

[22] Filed: Jul. 26, 1989

[51] Int. Cl.[5] ..... F25D 21/06

[52] U.S. Cl. ..... 62/155; 62/156; 62/158; 62/234

[58] Field of Search ..... 62/155, 156, 234, 256, 62/229, 152, 126, 127, 129, 130, 158

[56] References Cited

U.S. PATENT DOCUMENTS

| | | | |
|---|---|---|---|
| 2,765,630 | 10/1956 | Shaw | 62/4 |
| 3,453,837 | 7/1969 | Sandstrom et al. | 62/140 |
| 3,777,505 | 12/1973 | Otaki | 62/81 |
| 4,151,723 | 5/1979 | Gardner | 62/155 |
| 4,299,095 | 11/1981 | Cassarino | 62/156 X |
| 4,406,133 | 9/1983 | Saunders et al. | 62/156 X |
| 4,519,215 | 5/1985 | Barnett | 62/158 |
| 4,538,420 | 9/1985 | Nelson | 62/140 |
| 4,630,449 | 12/1986 | Adams | 62/130 |
| 4,663,941 | 5/1987 | Janke | 62/156 |
| 4,723,414 | 2/1988 | Harutachi et al. | 62/156 X |

OTHER PUBLICATIONS

Demand Defrost Control CR70A, Honeywell 60-20-70-5, pp. 1-13, 1974.

CEC KT33, Cooling Energy Control Limited, Wimbledon, London, pp. 1-3, (no date).

Frostec, Esswood Corporation, Cincinnati, Ohio, pp. 1-4, 1987.

*Primary Examiner*—Harry B. Tanner

*Attorney, Agent, or Firm*—Heslin & Rothenberg

[57] ABSTRACT

A demand defrost controller employs temperature measurements taken at the outlet of the discharge air curtain and the inlet of the air return to determine the need for defrost. If the difference between these temperature measurements exceeds a set point for a predetermined sustained period of time and a minimum amount of time has elapsed since the last defrost of the case, defrost is initiated. Regardless of the value of the temperature difference, defrost is initiated if elapsed time since the last defrost exceeds a specified maximum time between defrosts for the case. Defrost can be terminated on the basis of time and/or temperature. The demand defrost controller can also control display case temperature and can be applied to independently control multiple display case circuits.

20 Claims, 6 Drawing Sheets

DEMAND DEFROST CONTROLLER FOR REFRIGERATED DISPLAY CASES

BACKGROUND OF THE INVENTION

1. Technical Field

This invention relates generally to the field of controls for commercial refrigeration equipment and, more particularly, to demand defrost controllers for refrigerated display cases of the type commonly found in supermarkets.

2. Background Information

During the operation of refrigerated fixtures, such as display cases, frost accumulation occurs on the evaporator coils, because the operating temperature of the evaporator is typically below the freezing point of water. Defrost cycles are necessary to remove the accumulated frost and restore air flow through the evaporator coils. If not removed, the frost build-up inhibits heat transfer at the evaporator which in many instances prevents the evaporator from maintaining the fixture at the desired temperature. In severe situations, the lack of heat transfer at the evaporator will result in incomplete evaporation of the refrigerant which can lead to damage to the compressor.

Evaporator defrost is generally accomplished by one of the following methods:

Off-cycle—In this method the refrigeration is shut off to the fixture and the frost is allowed to melt. This technique is generally used in situations where the expected frost build-up is small and lengthy periods of no refrigeration will not cause damage to the refrigerated product.

Electric—Electric heaters are employed at the evaporator to melt the frost. Air is blown over the heater and then through the evaporator for this purpose. Defrost durations are short in most applications, but electric power consumption can be significant, especially in applications such as supermarkets where the amount of refrigerated fixtures that must be defrosted is large.

Air defrost—Certain display case manufacturers offer an air defrost which consists of redirecting the case air curtain flow such that warm, ambient air is passed through the evaporator, melting the frost.

Hot gas—With hot gas defrost, hot discharge gas from the compressors is piped through the evaporator where it condenses and melts the frost accumulation. At present, hot gas defrost is employed with multiple parallel compressor racks because a source for the hot gas used in the defrost is needed. With parallel compressor racks, multiple refrigerated circuits are normally piped to them which allows defrost of one of these circuits while the remainder of the circuits are kept refrigerated. These refrigerated circuits are the source of the hot gas for the defrost. Hot gas defrost is considered the quickest and least energy consuming type of defrost, but it is also the most complicated in terms of piping and control required.

The most common form of defrost now employed for commercial refrigeration is electric. Hot gas defrost is used exclusively with multiple compressor racks and is normally found in newer supermarkets where more sophisticated refrigeration equipment has been installed.

In terms of energy consumption, electric defrost is the greatest power consumer for defrost since electric heaters are used directly in the process. Added energy consumption is also experienced by the refrigeration system compressors due to the need to remove any excess heat introduced into the fixture during defrost and to return the fixture to the desired operating temperature. In the case of the use of hot gas defrost, energy consumption is greatly reduced since no electric heaters are employed, and the amount of heat added to the case for the defrost is minimized. Added compressor power consumption is incurred, however, after the defrost, for the purpose of lowering the temperature of the fixture to the desired level.

Presently, defrosts for refrigerated fixtures, such as display cases, are most commonly controlled by the use of a time clock that schedules the defrosts on a regular basis. The time interval between defrosts for a particular display case is set based upon operation at design conditions, which are typically 75° Fahrenheit, dry bulb temperature, and 55% relative humidity. However, the ambient humidity in which the refrigerated fixture is operated is often less than the design value. At these times, defrost is not required as often and unnecessary defrosts are incurred due to the inflexibility of the time clock control. The penalty associated with unnecessary defrosts is added electric consumption by electric defrost heaters, where employed, and by the refrigeration compressors which must provide added refrigeration to return a display case to the desired operating temperature immediately after defrost.

Modifications have been made to the conventional defrost time clocks to allow them to adjust to some extent to actual operating conditions. One such timer changes the time between defrosts based upon the time required to complete the previous defrost. Another type of adaptive controller varies the time between defrosts based upon the ambient humidity in the store. A shortcoming of this latter type of controller is that no attempt is made to assess defrost requirements on an individual case basis. Unnecessary defrost may still occur because the number of defrosts per case has not changed.

To eliminate unnecessary defrosts, attempts have also been made in the past to develop demand defrost systems which determine through measurement when defrost is required. The various types of demand defrost systems that have been tried include the following:

Frost sensors—An optically based sensor is located at the evaporator for the purpose of detecting frost build-up. When the frost reaches a preset thickness, the defrost is initiated. Several sensors of this type have been marketed with only limited success. The primary problems incurred have been that the sensors were susceptible to triggering unnecessary defrosts and tended to be maintenance intensive. Because the sensor was located at the display case evaporator, replacement of a failed sensor was very difficult, often requiring removal of refrigerated product from the case. For this reason the tendency was to replace the failed sensor with a time clock.

Temperature sensors—A demand defrost controller was developed and introduced by Honeywell Corporation (reference U.S. Pat. No. 3,777,505). The controller employed two temperature sensors located adjacent the inlet and outlet, respectively, of the display case evaporator. Defrost was initiated when the temperature difference between the two sensors reached a set point. This controller did not gain wide acceptance because it was prone to triggering defrost unnecessarily. Like the frost sensors, the temperature sensors were located at the display case evaporator, making them difficult to service.

Pressure sensors—The change in pressure drop on the air side of the evaporator as frost deposits on the surface represents a possible method of determining when defrost is required. The size of this pressure difference is relatively small, on the order of hundredths of inches WC, which is difficult to measure accurately. For this reason, the cost of pressure sensors is prohibitively high to make them attractive for defrost control.

In general, previous attempts to employ various measurements, such as frost thickness, temperature, and air pressure, for demand defrost have met with only marginal success. The reasons for this include the following:

sensor failure which can occur occasionally and either fail to initiate defrost when needed or trigger unnecessary defrost;

sensor readings are misinterpreted by the controller, initiating unnecessary defrost. In this instance, activity at the display case such as stocking, cleaning, etc. has caused a sensor reading similar to that produced when defrost is required.

Failure of the defrost controller for the above reasons often lead to service calls for the refrigeration equipment, loss of refrigerated product, etc. Accordingly, at present, no demand defrost control system has gained wide spread acceptance.

A need thus persists for a cost effective, energy saving, demand defrost controller which affords improved performance, reliability and maintainability in governing defrost frequency of a display case.

SUMMARY OF THE INVENTION

This need is satisfied and the shortcomings of the prior art overcome, in accordance with the present invention, by provision of a demand defrost controller which employs as defrost initiation criteria: a minimum difference in measured air curtain temperature readings, and minimum and maximum time intervals between defrosts. Using temperature measurements taken at the outlet of the discharge air curtain and at the inlet of the air return of a refrigerated display case, a temperature difference is calculated and the controller is programmed to allow defrost initiation if this temperature difference exceeds a specified temperature difference setting for a predetermined number of measurement cycles, and elapsed time since the last defrost of the case exceeds a specified time setting representative of a predetermined minimum time interval between defrosts. Elapsed time is also compared to a time setting representative of maximum allowable time between defrosts and defrost of the case is initiated, regardless of the temperature difference, when elapsed time exceeds the maximum time between defrost setting.

Requiring the temperature difference (actual or average) to remain above a threshold setting for a sustained period of time, avoids triggering of unnecessary defrost by sudden changes in temperature readings caused by case activity, etc. The minimum time between defrost criterion for initiating defrost serves as a backup to the temperature sensor measurements so that unexpected operating conditions or sensor failure will not initiate unnecessary defrost. Similarly, the triggering of defrost upon the occurrence of a maximum time interval since the last defrost, serves to guard against sensor failure which might prevent a defrost when required.

In another aspect of the invention, the controller can be programmed to issue a warning that the case has not recovered from a prior defrost when the sensed discharge air temperature exceeds a specified temperature setting, and to optionally inhibit initiation of defrost, in response to the combined temperature difference—minimum time criteria, for so long as the sensed discharge air temperature exceeds said setting.

In accordance with another aspect of the invention, the controller terminates defrost when one of the following termination criteria is satisfied: (a) elapsed time since defrost initiation exceeds a time setting representative of maximum defrost duration or (b) measured discharge air temperature exceeds a temperature setting representative of maximum defrost temperature.

The controller of the present invention can also advantageously be employed to control the refrigeration of the display case through a comparison of discharge air temperature with a specified refrigeration temperature setting. The controller is also capable of independently controlling multiple display case circuits by implementing an iterative process in which each circuit is successively examined to determine whether defrost of that circuit should be initiated and by queuing of circuits requiring defrost while another circuit is undergoing defrost.

The temperature sensors employed in the present invention preferably are low power, potted, current flow type sensors. The controller preferably includes: a programmable microprocessor; an analog multiplexer, controlled by said microprocessor, for receiving signals from the temperature sensors and passing signals through an A/D converter to said microprocessor; digital I/O for connecting outputs of the microprocessor to defrost and compressor devices for display cases; operator interface means, preferably, a keypad and display, connected to said microprocessor; and memory means, a real time clock, a system clock, a power supply and battery back-up all connected to said microprocessor.

This invention provides a cost effective, energy saving, easy to use and maintain, intelligent demand defrost controller for a display case which exhibits superior reliability and performance. Specific benefits afforded by this invention include:

reduction in electric energy consumption by defrost heaters, when electric defrost is employed;

reduction in electric energy consumption by the refrigeration compressors, for any type of defrost, due to a reduced number of times a display case must be lowered in temperature after defrost;

improved refrigerated product appearance and quality due to less variation in temperature caused by exposure to defrost;

increased serviceability because temperature sensors are located at positions in the display case where the servicing and replacement of a sensor can be accomplished with minimal effort;

greater reliability due to the use of a relatively simple measurement technique and more comprehensive control logic;

reduced maintenance due to controller simplicity; and enhanced cost effectiveness by combining the defrost with other control functions such as case refrigeration control and/or by applying the controller to multiple display case circuits.

BRIEF DESCRIPTION OF THE DRAWINGS

These and other objects, features, aspects and advantages of the present invention will be more readily understood from the following detailed description when read in conjunction with the accompanying drawings in which.

DETAILED DESCRIPTION

Figure 1:
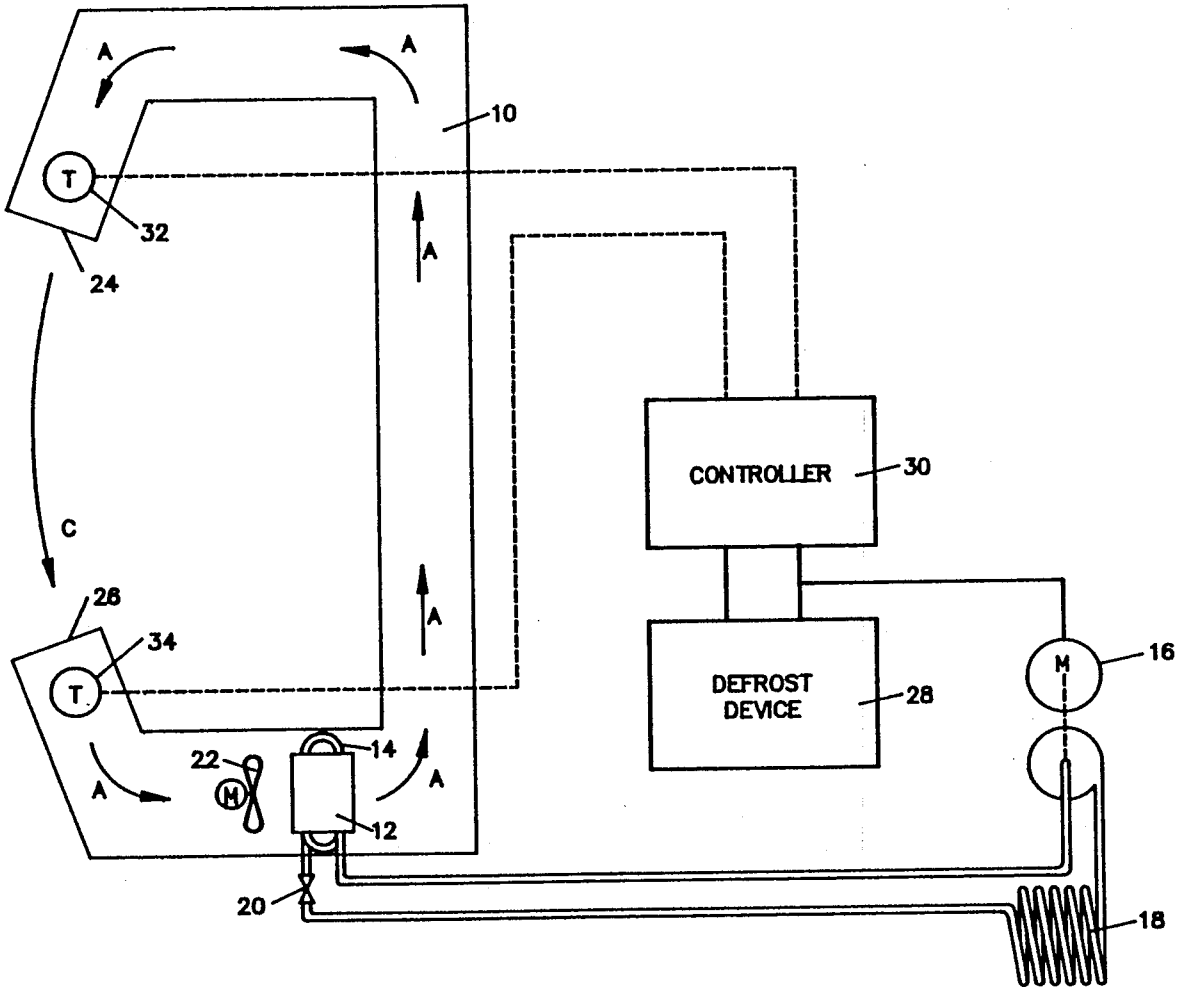
FIG. 1 is a schematic representation of demand defrost control apparatus of the present invention employed in conjunction with a refrigerated display case.

Referring now to FIG. 1, a refrigerated display case 10, typical of those found in supermarkets, is shown. Case 10 includes an evaporator 12 containing cooling coils 14. The evaporator 12 is part of a refrigeration system which also includes, in known fashion, compressor motor 16, condenser 18, an expansion valve 20 on the inlet side of evaporator 12, and suitable piping for conveying cooling medium through the refrigeration system. A fan 22 is operable to move air through cooling coils 14 along a path indicated generally by arrows A. An air curtain, represented by arrow C, passes over the contents (not shown) of case 10, from an outlet 24 of the discharge air curtain to an inlet 26 of the air return.

In normal operation of the refrigeration system of display case 10, frost is formed and builds up on evaporator coils 14. Defrost cycles are necessary to remove the frost and restore air flow through and heat transfer into these refrigeration coils. A defrost device 28, of any known variety, is provided for this purpose.

In order to control the defrosting of frost on evaporator coils 14 by defrost device 28, and to achieve the previously enumerated benefits of the present invention, a defrost controller 30 is employed, in conjunction with two temperature sensors 32 and 34. As shown, both temperature sensors are located remote from evaporator 12. The first temperature sensor 32 is located in the vicinity of outlet 24 and measures discharge air temperature. The second temperature sensor 34 is located in the vicinity of the inlet 26 of the air return and measures return air temperature. Measurement readings from the temperature sensors are provided back to the controller 30 during each measurement cycle.

Although different types of temperature measuring devices may be used, temperature sensors 32, 34 are preferably small, low power devices which use current flow, not voltage, as the electrical signal. The latter feature reduces electrical noise pick-up in the wires connecting the sensors to the controller, which wires may run hundreds of feet in the modern supermarket. The temperature and the humidity environment of the sensors change regularly with defrost cycles. Accordingly, it is desirable to pot the sensors, e.g. in 22 caliber cases using quick curing epoxy or other known potting compounds. In a field tested version of the present invention, model AD592 sensors available from Analog Devices of Norwood, Massachusetts were used. These sensors have good linearity and accuracy and accordingly can readily be multiplexed into a common electrical interface. In known fashion, the interface can provide scaling so that any temperature range can be fit into an 8-bit analog-to-digital converter voltage range. The current choice of temperature range is −35° C. to +35° C. which provides a temperature resolution of 0.5° F. over that range.

The behavior of the discharge and return air temperatures, as measured by sensors 32 and 34 respectively, during operation of display case 10 will now be described. As frost accumulates in the evaporator 12, the frost tends to increase resistance to air flow which limits the output of the display case fan 22. Since less air is passed through the evaporator 12, less refrigeration is provided to the contents of the display case. The discharge air temperature is still lowered to approximately the desired value because the reduction in air flow reduces the amount of heat removal needed to reduce the temperature of the air. The decrease in refrigeration provided along with the breakdown of the display case air curtain, both caused by the reduction in air flow, produces a rise in the return air temperature. Thus, as frost accumulates on the evaporator 12, the discharge air temperature measured by sensor 32 remains substantially constant while the temperature difference between the discharge air and return air increases. It is this latter characteristic which the present invention uses as an important indicator of the defrost requirement of a display case.

Figure 2:
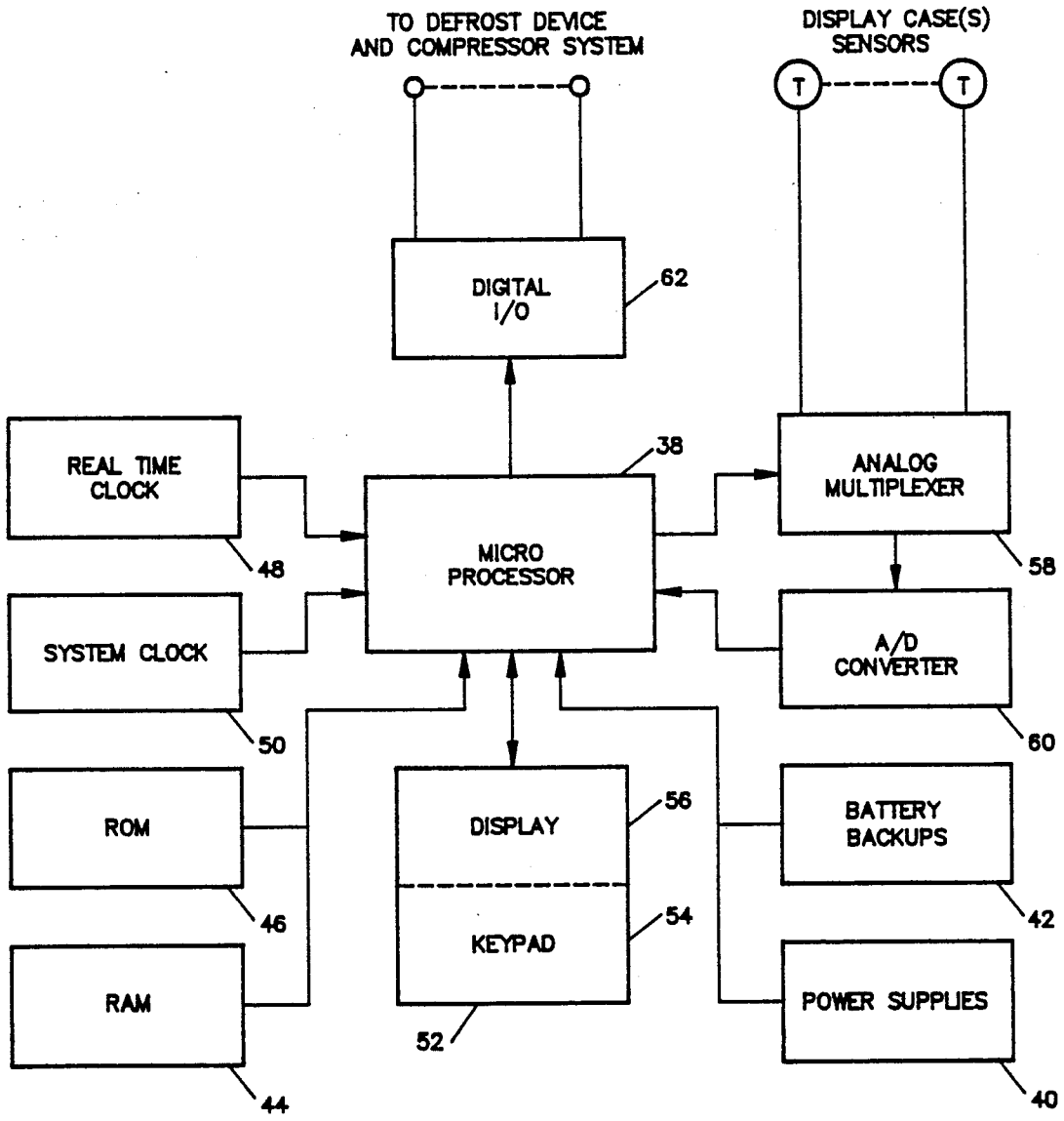
FIG. 2 is a block diagram depicting the interconnection of components of a demand defrost controller constructed in accordance with the principles of the present invention.

FIG. 2 depicts in greater detail, the presently preferred components of a demand defrost controller of the present invention. At the heart of the controller is a microprocessor 38 such as M50734SP available from Mitsubishi of Sunnyvale, California. The microprocessor and its program provides the intelligence for the demand defrost controller.

Associated with microprocessor 38, is a conventional power supply 40 and, preferably, battery back-ups 42 in the event of failure of power supply 40. Memory, e.g. random access memory (RAM) 44 and read only memory (ROM) 46, provides sufficient storage for all of the variables and programs required by the controller. Stored variables for each case or circuit (i.e. group of interconnected cases) include: measured discharge air temperature, measured return air temperature, a temperature difference setting, minimum time between defrosts, maximum time between defrosts, actual time since last defrost, sustained time interval for temperature difference to trigger defrost, defrost cycle maximum duration, defrost cycle maximum temperature, and various other temperature settings. These variables and the programs which operate thereon will be described, in detail, hereinafter.

Controller 30 preferably also includes a real time clock 48, a system clock 50 and an operator interface 52. The clocks can be implemented in conventional fashion. Operator interface 52 preferably includes a keypad 54 such as model 89-252, available from Grayhill, of LaGrange, Illinois and a liquid crystal display 56, such as the 2-line LCD model LM24A2C40CB available from Densitron of Japan.

For a single case or circuit controller, the keypad 54 and display 56 provide a convenient means of setting and showing the adjustable parameters. The keypad allows both time and temperature settings to be entered in a standard pushbutton interface which is easy for users. The electrical connection to the microprocessor 38 is done using an efficient scanned matrix approach. The display, in addition to showing the parameters, displays the current time and both case temperatures as well as the case refrigeration status. The display is a liquid-crystal type for ease of viewing and low power use. The low power is especially important for battery back-up operation.

For multiple circuits, the keypad and display provide all the above functions for all the circuits with all the benefits, with no additional equipment. In addition, for refrigeration systems with hot gas defrost which can only defrost one circuit at a time, the display shows the queue of circuits waiting for defrost. By way of example and not limitation, a 2-line display 56 can be set up so that the top line shows the time and then letters which show the current status of the circuits, and then number of circuits the controller is controlling. The status of the circuits could be R, D, and Q; refrigeration, defrost, and queue, respectively. Refrigeration (R) is the condition in which the compressors are cooling the circuit. Defrost (D) is a switch closure, for example by solid state relay, which reverses the heat flow in the circuit to defrost the circuit. Queue (Q) is the status of a second (third, fourth, etc.) circuit which needs defrosting but can't be defrosted immediately because another circuit is already defrosting. When the other circuit is finished defrosting, the circuit in the Q status with the lowest circuit number may be changed to defrost (D) status. Circuits in the queue (Q) status continue to refrigerate until their time for defrost comes.

The lower line of the display may be reserved for user interaction with the controller. For instance, the user may select special functions using the keypad to select the mode of interaction the user wishes. Such special functions might include: select circuit for display, initiate defrost on selected circuit, cancel defrost on selected circuit, change parameters on selected circuit, allow updating of clock time, enter data into controller, etc. The detailed implementation of the operator interface does not form part of the present invention and various implementations can be readily accomplished by those skilled in the relevant art.

As shown in FIG. 2, electrical signals from the display case(s) sensors are received by analog multiplexer 58, which is under control of microprocessor 38. Multiplexer 58, in conventional fashion, selectively provides temperature readings from the sensors to microprocessor 38 through standard analog-to-digital (A/D) converter 60. These inputs are processed by microprocessor 38, as more fully described hereinafter, to produce output signals which are passed through a standard digital I/O 62 and control operation of defrost device 28 and, optionally, compressor 16.

The operation of the demand defrost controller of the present invention will now be described. The control program developed to determine when defrost is required in a refrigerated display case 10 (or cases or circuits of cases) employs temperature measurements taken at the outlet 24 of the discharge air curtain and the inlet 26 of the air return. Using these two measurements, a temperature difference is calculated by controller 30. This temperature difference is compared to a specified temperature difference setting and, if the difference exceeds the setting, a defrost can be initiated if certain other criteria are met. The temperature difference must exceed the temperature difference setting for a certain predetermined number of measurement cycles (alternatively, the average temperature difference is calculated and the time average of the temperature average must exceed the set point) and a minimum amount of time must have elapsed since the last defrost of the particular display case before a defrost can be initiated. While measurement of the temperature difference is computed, total elapsed time since the last defrost is also compared to a maximum time setting between defrosts by controller 30. If elapsed time exceeds the maximum time setting, defrost is initiated, regardless of the value of the temperature difference.

Figure 3A:
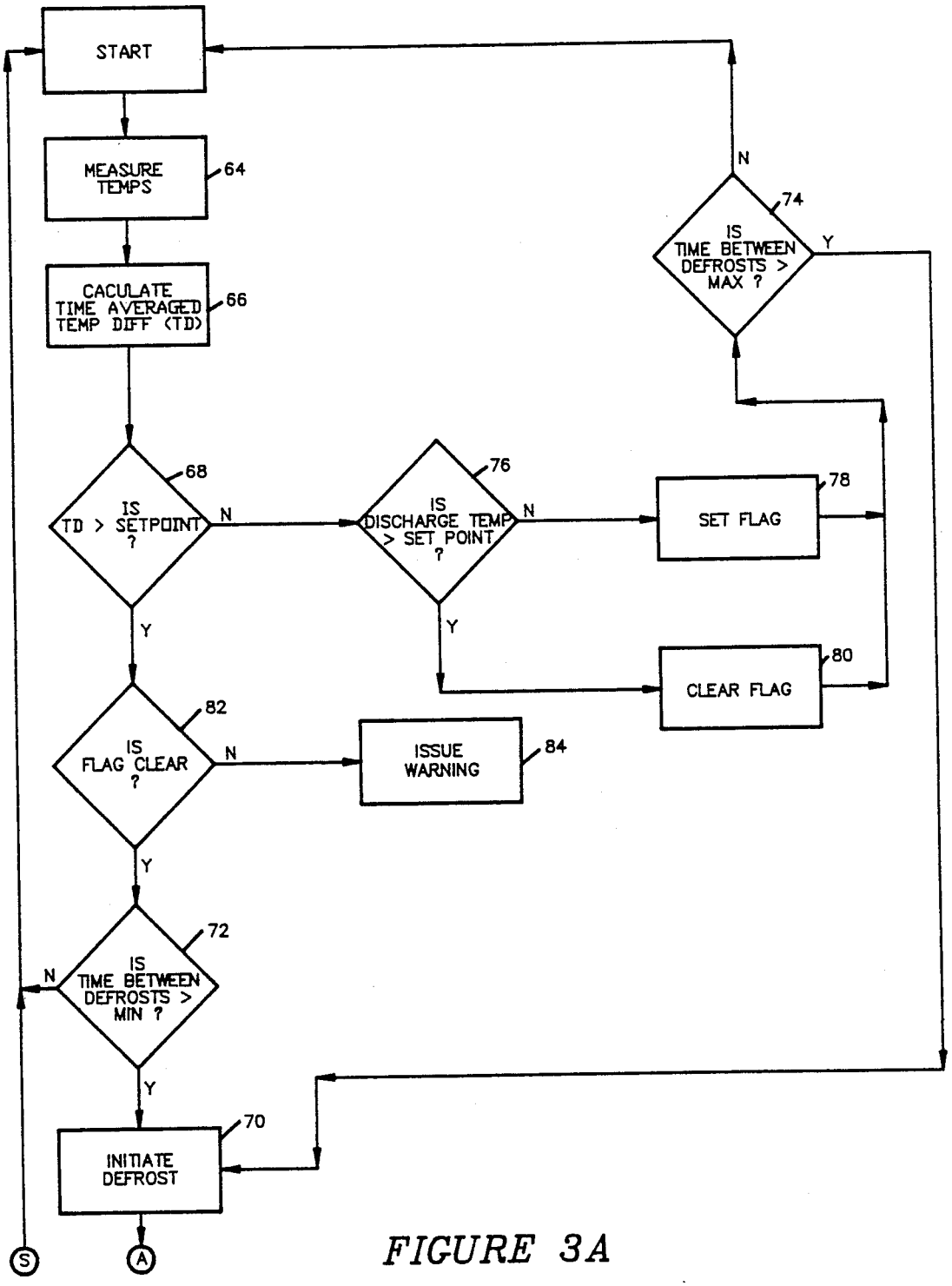
FIGS. 3A and 3B show a flow diagram of a single display case defrost control program useful in a demand defrost controller of the present invention.
Figure 3B:
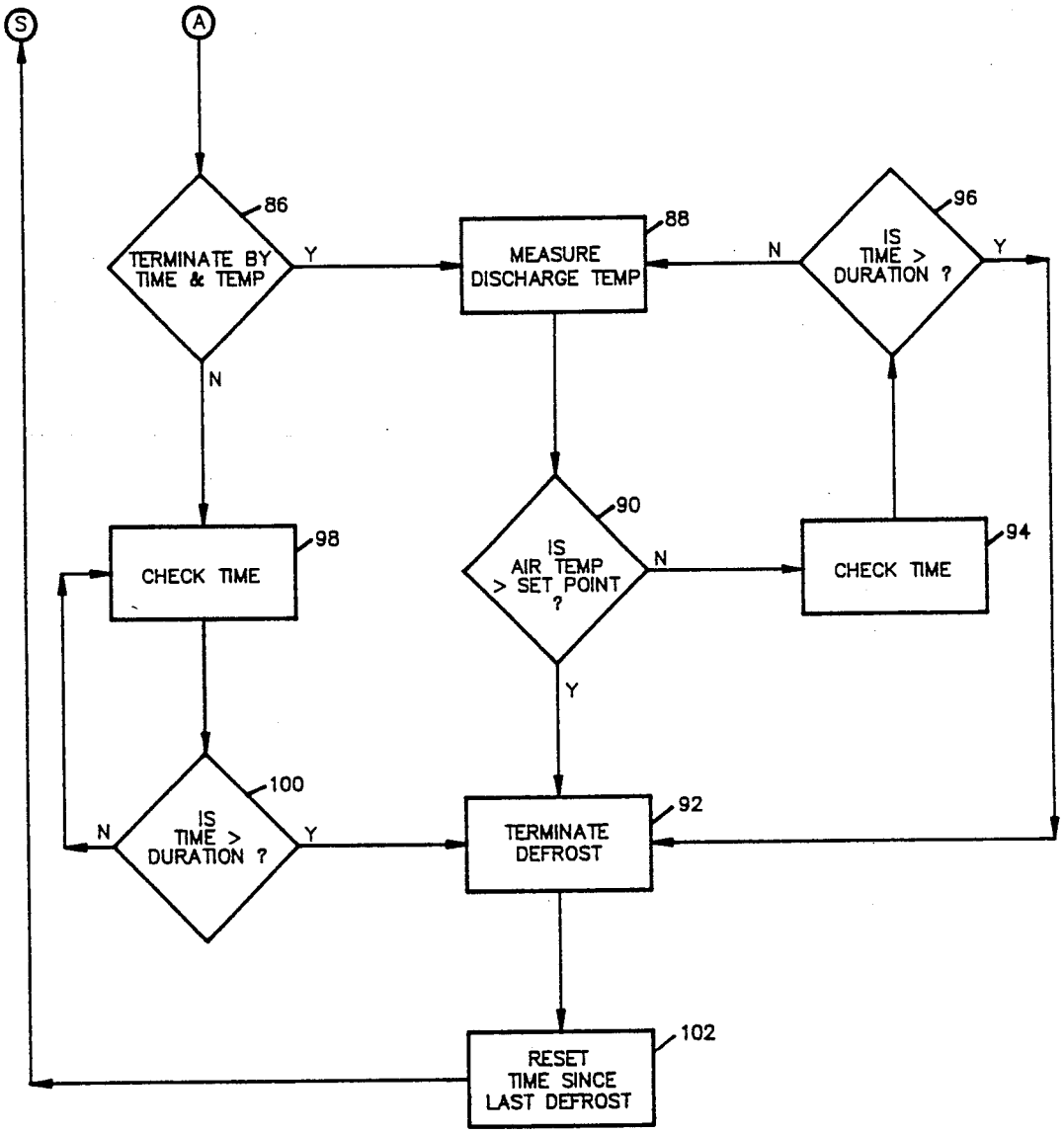

A simplified flow diagram of the defrost control program for a refrigerated display case is presented in FIGS. 3A and 3B. The program is implemented by controller 30. The program begins with a measurement of the discharge and return air temperatures of the display case (box 64), as previously described. A temperature difference (return-discharge) is then determined, and the time averaged value of the difference is then calculated (box 66) and compared to a specified temperature difference setting or set point for the display case (box 68). If the difference is not greater than the set point, the control program returns to the start, the temperature measurements are repeated and the difference is again compared to the set point.

If the temperature difference set point is exceeded, defrost is initiated (box 70), provided the elapsed time since the last defrost of the display case is also greater than a preset minimum value (box 72). If the elapsed time since the last defrost has not reached the minimum value, the control program returns to start.

After comparison is made with the temperature difference and, if this comparison routes the control program back to start, the elapsed time since the last defrost is compared to a maximum time between defrost (box 74). If the elapsed time exceeds the maximum time, defrost is initiated.

The discharge air temperature is also compared to another set point (box 76), and if this temperature is greater than the set point and a defrost was recently completed, a flag is set (box 78). The flag remains set until it is cleared when the discharge air temperature falls below the set point during a later measurement period (box 80). The status of the flag is checked (box 82) prior to the initiation of defrost. If the flag is set, a warning is issued (box 84) that the case has not recovered, in terms of temperature, since the last defrost performed. An optional control feature can be added here that would block the initiation of the defrost until the discharge air temperature is lowered to the correct value. If the flag is clear when checked, defrost initiation proceeds.

After initiation of defrost has begun, the control program is then used to determine when defrost should be terminated. The controller 30 can be used to terminate by time only, or by a combination of time and temperature. The type of termination used may be operator selected. For time and temperature termination, (box 86), the control program first measures the discharge air temperature (box 88) and compares this temperature against a set point representative of maximum defrost temperature (box 90). If the discharge air temperature exceeds this set point, the defrost is terminated (box 92). If the set point is not exceeded, elapsed time of the defrost is checked (box 94) and compared to a maximum defrost duration (box 96). When the elapsed time exceeds this duration, defrost is terminated (box 92). The control program continues to check the discharge air temperature and the elapsed time until one of the termination criteria is met. At that time, the defrost is terminated. For termination by time alone, the elapsed time is compared against the maximum defrost duration (boxes 98 and 100). When the elapsed time exceeds the duration, defrost is terminated (box 92). At the end of the defrost, the time of the defrost for that particular display case is noted by the control program (box 102). The new time value is later used for the maximum-minimum time comparisons.

The above described program clearly affords considerable flexibility in setting and modifying the various variables used in the control program. In one implementation of this program, the following variable values were employed:

Temperature difference setting: 10° F.;
Minimum time between defrost: 8 hours;
Maximum time between defrost: 24 hours;
Maximum defrost duration: 20 minutes;
Maximum defrost temperature: 40° F.;
Temperature set point for flag setting: −10° F.

To increase the versatility and reduce the first cost impact of the new demand defrost controller, a display case temperature control routine can be added to the defrost control program. Temperature control can be added to any display case. For example, for thermostat and solenoid valve control, the controller will replace the thermostat. The advantage of adding temperature control is that the thermostat can be deleted during case manufacture. For a display case that already has defrost control, it is a simple matter to add solenoid-type temperature control. The sensor for temperature control already exists, as the discharge air temperature sensor, and solenoid control simply requires one more digital output line from the controller to actuate the solenoid valve through, for example, a solid state relay.

Figure 4:
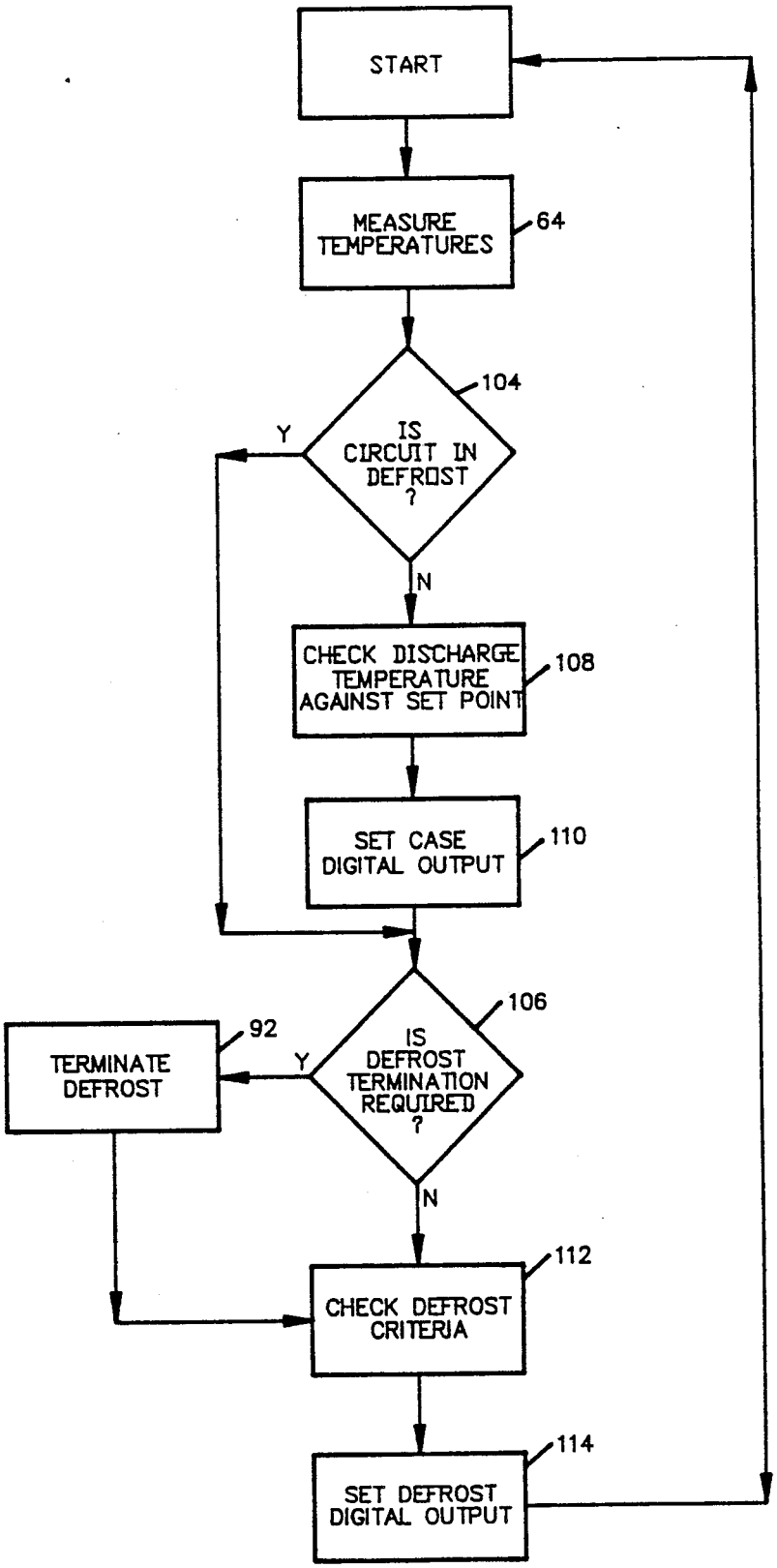
FIG. 4 is a flow diagram of a combined temperature and demand defrost control program of the present invention.

A flow diagram for the combined temperature and demand defrost control program of the present invention, is shown in FIG. 4. As before, the discharge and return air temperatures are first measured (box 64). The display case is then checked to see if it is in defrost (box 104). If so, the defrost termination criteria is then checked (box 106). If the case is not in defrost, the controller then executes a case temperature control routine in which the discharge air temperature is compared to a refrigeration temperature set point for the display case (box 108). The digital output for the case temperature is then set (box 110). If the value of the measured discharge air temperature exceeds the refrigeration temperature set point, refrigeration to the case is initiated. If the value of the discharge air temperature is less than that of the set point, refrigeration is terminated. Refrigeration to the display case can be initiated or terminated by the operation of a solenoid valve located in the liquid refrigerant line. Opening the solenoid valve allows liquid refrigerant to flow into the evaporator, producing refrigeration for the case. Closing the valve, stops liquid refrigerant flow and terminates the refrigeration process.

The controller then executes the defrost control routine by: determining whether defrost termination is required (box 106) and, if so, terminating defrost (box 92), and checking the defrost criteria (box 112) and then setting the defrost digital output (box 114), as previously described. At completion, the control loop returns to start and the control program is repeated.

In modern supermarkets, display cases are generally grouped into multiple, separate circuits. The demand defrost controller of the present invention is readily adaptable to control such multiple display case circuits and provide independent temperature and defrost control for each.

Figure 5:
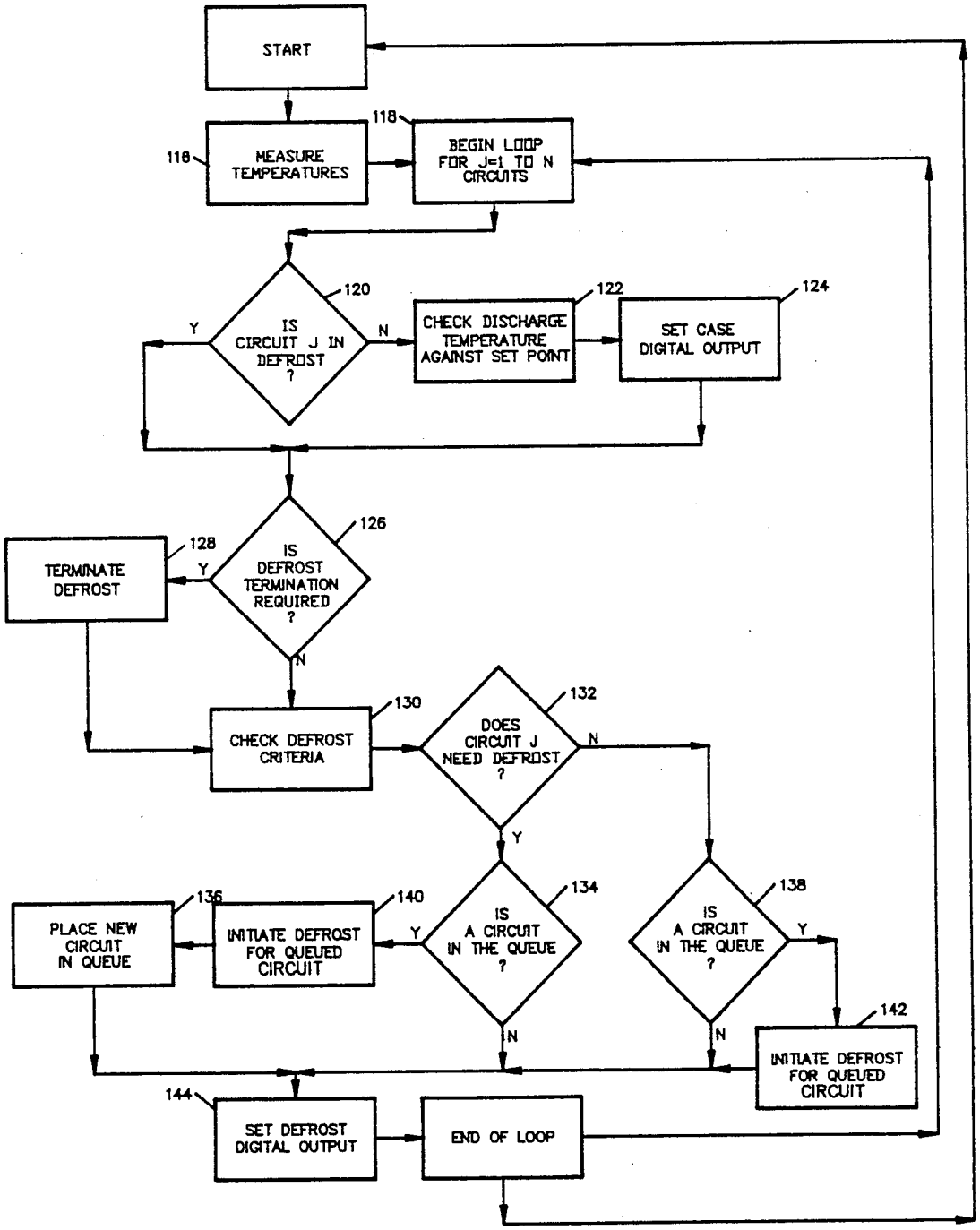
FIG. 5 is a flow diagram of a combined defrost and temperature control program intended for control of multiple display case circuits in accordance with the present invention.

A flow diagram for a combined defrost and temperature control program that allows independent control of multiple display case circuits is shown in FIG. 5. In the embodiment to be described, it is assumed that control of temperature is handled on the case level while defrost is handled on a circuit level. Other approaches are, of course, possible.

Referring to FIG. 5, the controller begins by reading the discharge and return air temperatures for all cases being controlled (box 116). A control loop is then begun (box 118) in which the temperature measurements for each case are compared to the set points for that particular display case. The case being examined is first checked to see if it is in defrost (box 120). If so, the temperature control portion of the program is skipped. If not in defrost, the display case discharge air temperature is compared to a refrigeration temperature set point, e.g. 0° F. (box 122). Refrigeration to the case is either initiated or terminated depending on the value of the discharge air temperature (box 124). The program then checks if any display cases are in defrost and if the defrost should be terminated (box 126). If termination is required, it is done at this time (box 128).

The control program then checks the defrost criteria for the display case being examined (box 130) to determine whether that case and, in this example, the corresponding circuit, needs defrost (box 132). As previously described in detail, the defrost criteria involves a determination of the difference between the return and discharge air temperatures of the case and a comparison of this temperature difference to an appropriate set point. Minimum and maximum times between defrost are also checked against elapsed time.

If the defrost criteria is satisfied by the display case being examined, indicating a need to defrost the corresponding circuit, a check is then made to determine whether another circuit is already in queue for defrosting (box 134). In certain instances, multiple display cases may require defrost simultaneously, or defrost of a display case is indicated prior to the completion of defrost of another case. In either situation, a delay in the initiation of a defrost of the current case/circuit being examined must be imposed. This is accomplished by placing the identification of the current case/circuit in a queue (box 136). The queue is checked during each pass through the control program (boxes 134, 138) and defrost is initiated for a circuit previously placed in the queue, as appropriate (boxes 140, 142 and 144). In this fashion, circuits in queue can be sequentially defrosted while those circuits remaining in queue continue to refrigerate until their time for defrost occurs.

The inner control loop repeats until all of the circuits are thus checked against the defrost criteria, etc. and then the full program, including the temperature measurements, repeats.

As will be apparent from the preceding detailed description, a unique demand defrost controller has been developed which initiates defrost when a temperature difference between discharge and return air of a display case reaches a prescribed, adjustable set point. The temperature difference comparison includes time averaging of data and discarding of short term fluctuations. The control program also includes specified fixed minimum and maximum limits on the length of time between defrosts. The latter serving as a back-up time clock in the event of system failure. Case temperature control for refrigeration, in either an individual case or multiple circuit environment, can be incorporated into the defrost control program.

The demand defrost controller of the present invention reduces the total number of defrost cycles in supermarket display cases as compared to the standard time clock, thereby resulting in energy and cost savings, reduced product deterioration and minimized wear on refrigeration equipment. The controller is capable of wide application, is easy to use and maintain, and provides improved reliability and performance compared to earlier control devices. Further, the controller is compact, flexible, intelligent, and operable in varying temperature and humidity environments.

Although several embodiments of the invention have been described and depicted herein, it will be readily apparent to those skilled in this art that various modifications, substitutions, additions and the like can be made without departing from the spirit of the invention, the scope of which is defined by the claims appended hereto.

What is claimed is:

1. Demand defrost control apparatus for automatically controlling defrost of a refrigerated display case, comprising:

first temperature sensing means located near an outlet of the discharge air curtain of the display case for measuring discharge air temperature;

second temperature sensing means located near an inlet of the air return of the display case for measuring return air temperature; and control means, connected to said first and second temperature sensing means, for ascertaining a temperature difference between the measured return air temperature at the inlet and the measured discharge air temperature at the outlet and for determining whether said temperature difference exceeds a temperature difference setting for a predetermined sustained period of time.

2. The apparatus of claim 1, wherein said control means determines whether said temperature exceeds a temperature difference setting continually for a predetermined sustained period of time, and said first and second temperature sensing means are located remote from an evaporator of the display case.

3. The apparatus of claim 2, wherein said control means determines whether the ascertained temperature difference exceeds said temperature difference setting for a predetermined number of successive temperature measurement cycles.

4. The apparatus of claim 2, wherein said control means ascertains an average of said temperature difference over said sustained period of time and determines whether said average exceeds said temperature difference setting.

5. The apparatus of claim 2, wherein said control means determines elapsed time since the last defrost of the case and initiates defrost of the display case when both of the following conditions concurrently occur: (a) the ascertained temperature difference exceeds said temperature difference setting for said sustained period of time and (b) said elapsed time exceeds a first time setting representative of a predetermined minimum time interval required for frost accumulation.

6. The apparatus of claim 2, wherein the control means determines elapsed time since the last defrost of the case and initiates defrost, regardless of the ascertained temperature difference, when said elapsed time exceeds a maximum time setting representative of a predetermined maximum time interval between defrosts.

7. The apparatus of claim 5, wherein the control means also initiates defrost, regardless of the ascertained temperature difference, when said elapsed time exceeds a second time setting representative of a predetermined maximum time interval between defrosts.

8. The apparatus of claim 7, wherein the control means terminates defrost when one of the following termination criteria is satisfied: (a) elapsed time since defrost initiation exceeds a third time setting representative of maximum defrost duration and (b) measured discharge air temperature exceeds a temperature setting representative of maximum defrost temperature.

9. The apparatus of claim 8, wherein said control means further employs the measured discharge air temperature to control refrigeration of the display case.

10. The apparatus of claim 8, wherein the defrost of multiple display case circuits is independently controlled by said control means, each circuit containing one or more display cases, at least one display case in each circuit being provided with respective first temperature sensing means and second temperature sensing means connected to said control means, and wherein said control means implements: (a) a sequential process in which each circuit is successively examined to determine whether defrost of that circuit should be initiated, and (b) queuing of circuits requiring defrost while another circuit is undergoing defrost.

11. The apparatus of claim 8, wherein said first and second temperature sensing means comprise low power, potted, current flow type sensors.

12. The apparatus of claim 10, wherein said controller comprises:

a programmable microprocessor;

an analog multiplexer, controlled by said microprocessor, for receiving signals from the temperature sensing means and passing said signals through an A/D converter, to said microprocessor;

digital I/O means for connecting outputs of the microprocessor to defrost means and refrigeration means for the display cases; and operator interface means connected to said microprocessor.

13. The apparatus of claim 12, wherein said operator interface means comprises a keypad and display; and further comprising: memory means, a real time clock, a system clock, a power supply and battery back-up all connected to said microprocessor.

14. A demand defrost controller for a refrigerated display case having a first temperature sensor on an input side of an evaporator of the case and a second temperature sensor on the output side of the evaporator, and wherein a difference in temperatures sensed by said first and second sensors is used to control defrosting of the case, characterized by:

the first and second sensors being located remote from the evaporator; and the controller being programmed to initiate defrost when the following first set of conditions occur: said sensed temperature difference exceeds a temperature difference setting continually for a predetermined sustained period of time, and elapsed time since the last defrost exceeds a preset minimum allowable time interval.

15. The controller of claim 14 further characterized by said first sensor being located in the vicinity of an inlet of the air return of the case, said second sensor being located in the vicinity of the outlet of the discharge air curtain of the case, and said controller being further programmed, as a backup, to initiate defrost, regardless of sensed temperature difference, when elapsed time since a last defrost of the case exceeds a preset maximum allowable time interval between defrosts.

16. The controller of claim 15 further characterized by the controller being programmed to issue a warning that the case has not recovered from a prior defrost when the temperature sensed by the second sensor exceeds a preset temperature, said controller being capable of inhibiting initiation of defrost in response to occurrence of said first set of conditions, for so long as the temperature sensed by said second sensor exceeds said preset temperature.

17. A method of automatically controlling, with a programmable controller, the defrosting, upon demand, of a refrigerated display case in which an air curtain is directed to pass over the contents of the case, comprising the steps of:

obtaining a discharge temperature reading for each measurement cycle by measuring air temperature at the outlet of the discharge air curtain of the case and providing said reading to the controller;

obtaining a return temperature reading for each measurement cycle by measuring the air temperature at the inlet of the air return of the case and providing said reading to the controller;

computing, with said controller, a temperature difference for each measurement cycle by subtracting the discharge temperature reading from the return temperature reading for that cycle;

determining, with said controller, elapsed time since a last defrost of the case;

employing the following set of conditions as mutually required defrost initiation criteria in said controller: the computed temperature difference exceeds a temperature difference setting for a predetermined number of measurement cycles, and elapsed time since last defrost of the case exceeds a minimum time between defrost setting; and with said controller, comparing said elapsed time to a maximum time between defrost setting, and initiating defrost, regardless of the computed temperature difference, when elapsed time exceeds said maximum time between defrost setting.

18. The method of claim 17 further comprising the step of terminating defrost by the controller when the controller determines that one of the following termination criteria is satisfied: (a) elapsed time since defrost initiation exceeds a time setting representative of maximum defrost duration, and (b) discharge temperature reading exceeds a temperature setting representative of maximum defrost temperature.

19. The method of claim 18 further comprising the step of controlling refrigeration of the display case, by the controller, by comparing the discharge temperature reading to a refrigeration temperature setting.

20. The method of claim 19 wherein the refrigeration and defrost of multiple display case circuits is independently controlled by said controller, each circuit containing one or more display cases, at least one display case in each circuit being provided with temperature sensors for obtaining respective discharge temperature readings and return temperature readings and providing said readings to the controller, and further comprising the steps of:

successively examining each circuit to determine whether defrost of that circuit should be initiated; and queuing of circuits requiring defrost while another circuit is undergoing defrost.

* * * * *

UNITED STATES PATENT AND TRADEMARK OFFICE

CERTIFICATE OF CORRECTION

PATENT NO. : 4,993,233

DATED : February 19, 1991

INVENTOR(S) : Borton et al.

It is certified that error appears in the above-identified patent and that said Letters Patent is hereby corrected as shown below:

COLUMN 12:

Claim 14, line 68, insert --required for frost accumulation-- between "interval" and ".".

Signed and Sealed this

Eighth Day of September, 1992

*Attest:*

DOUGLAS B. COMER

*Attesting Officer*

*Acting Commissioner of Patents and Trademarks*